United States Patent [19]

Haschke et al.

[11] Patent Number: 4,532,024

[45] Date of Patent: Jul. 30, 1985

[54] PROCESS FOR RECOVERY OF SOLVENT FROM TAR SAND BITUMEN

[75] Inventors: Elliot M. Haschke; Gerald A. Gimber, both of Lake Jackson, Tex.; Kenneth O. Groves, Midland, Mich.

[73] Assignee: The Dow Chemical Company, Midland, Mich.

[21] Appl. No.: 677,648

[22] Filed: Dec. 3, 1984

[51] Int. Cl.[3] ..... C10G 1/04

[52] U.S. Cl. ..... 208/11 LE; 585/867; 203/68

[58] Field of Search ..... 208/11 LE, 8 LE; 585/867; 203/67, 68

[56] References Cited

U.S. PATENT DOCUMENTS

| | | | |
|---|---|---|---|
| 3,941,679 | 3/1976 | Smith et al. | 208/11 LE |
| 4,029,568 | 6/1977 | Pittman et al. | 208/11 LE |
| 4,046,669 | 9/1977 | Blaine | 208/11 LE |
| 4,057,485 | 11/1977 | Blaine | 208/11 LE |
| 4,264,431 | 4/1981 | Ishikawa et al. | 208/11 LE |
| 4,347,118 | 8/1982 | Funk et al. | 208/11 LE |

*Primary Examiner*—D. E. Gantz
*Assistant Examiner*—A. Pal

[57] ABSTRACT

There is described a process based on unit operations conventionally employed but modified to enable the use of chlorinated solvents, particularly methylene chloride as the preferred solvent for extraction of the bitumen from the tar sands or shale. The process in general constitutes:

I. an extraction operation wherein the tar sand is contacted with the chlorinated solvent, particularly methylene chloride, to extract (dissolve) the bitumen from the sand;

II. a separation of the sand from the solvent bitumen extract;

III. (a) recovery of the bitumen free of extractant; (b) recovery of the sand free of extractant.

5 Claims, 4 Drawing Figures solvents consume more energy and/or are more readily hydrolyzable and can't be readily steam stripped.

If air or steam stripping is employed an additional step will be required to recover the solvent in an efficient manner. Present commercial techniques employ refrigerated coils, mineral oil absorption or carbon absorption. The refrigerated coils method is expensive to run and very inefficient. Carbon absorption and mineral oil absorption can be efficient depending on the volume and velocity of the solvent-laden air being stripped. However, both methods depend on steam stripping to recover the solvent from the absorbing media, i.e., mineral oil or activated carbon. Consequently, all methods in a sense, except refrigeration, involve a steam stripping step for solvent recovery.

In a steam stripping operation, the saturated water-solvent vapor is fairly easy to condense, and the separation of the condensed immiscible water and solvent phases can also be readily accomplished. However, this technology when applied to the recovery of chlorinated solvents must take into account that chlorinated solvents at high temperatures can be extensively hydrolyzed, forming hydrogen chloride. This can cause not only extensive damage to the distillation system, but the resultant corrosion product, $FeCl_3$, also will act as a catalyst and accelerate the hydrolysis reaction.

Another consideration is that all commercially available chlorinated solvents contain metal inhibitors and acid acceptors, which both slow the hydrolysis reaction and minimize the corrosive effect of the hydrochloric acid generated upon decomposition. These additives, in most cases, are water soluble and, consequently, depleted during the water-solvent separation stage, particularly when the ratio of water to solvent is large as is typical for a steam stripping operation. The depletion of the inhibitor system in the solvent sent back to recycle will require inhibitor addition to prevent corrosion damage throughout the extraction process unless the vapor portion of the solvent is feed for recycle before steam is used. A preferred technique is to use a two stage non-steam solvent removal process, one in which the solvent is removed without contact of the solvent with steam. This is accomplished by a simple distillations of the major portion of the solvent followed by a second step which uses a a high-boiling stripper diluent (S-D) solvent (in place of steam) to remove the residual solvent.

This latter technique, as presently envisioned also serves several other purposes. It is fairly easy to control, since it involves only a volume addition of the S-D solvent to the solvent-bitumen solution (miscella) preferably subsequent to the major solvent removal by simple distillation. With the proper S-D solvent, essentially complete removal of residual solvent is accomplished by monitoring the temperature of the exiting bitumen product stream.

Bitumens vary considerably in viscosity, depending on their source. In the U.S., bitumens with viscosities of $10^7$ to $10^3$ poise are normal. Since these products may have to be transported considerable distances to a refinery for upgrading, they should be pumpable upon delivery. This can be accomplished by leaving a few percent of the S-D solvent in the bitumen as a viscosity modifier. Ideally, in order to minimize costs, it is desirable to choose a S-D solvent which has an acceptable boiling point to strip out all residual chloride and is a natural product stream generated during the bitumen upgrading process. A solvent of this nature can easily be recycled between the extraction and upgrading plants.

A third purpose which the S-D solvent serves is that it is a mechanism to guarantee the recovery of inhibitor and acid acceptor additives normally contained in commercial chlorinated solvents, without the solvent contacting any water.

In a tar sand extraction process, the conditions which are most likely to lead to the hydrolytic and thermal decomposition of an improperly inhibited chlorinated solvent are those generally present in the distillation and recovery section of the process. Consequently, this is the portion of the process which will require the most protection. The stripper diluent technology is designed to give excellent flexibility, by adding to the S-D solvent a high boiling inhibitor, which inhibitor will be confined by the recovery of the stripper-diluent to the second stage distillation section of the solvent recovery process. The conventional inhibitors designed to boil with the solvent of course go overhead with the bulk solvent removal to protect it in the lower temperature sections of the process.

Most tar sand extraction techniques which have previously been considered are multistaged, agitated tank processes. This comes about since many of the solvents proposed for use have limited solvency for bitumen and dissolution occurs incompletely and at a relatively slow rate. Consequently, large volume ratios of solvent to sand are required, and by necessity a fairly dilute miscella is fed to the distillation system.

Because bitumen is soluble in methylene chloride in all portions excellent dissolution rates, even with essentially no agitation present or achievable. This permits the use a single mixing-extraction stage with a minimum volume of solvent in which the dissolution of the bitumen occurs thereby to producing a higher bitumen concentration in the extracting solvent.

A preferred embodiment of the present invention for a continuous tar sand extraction is shown in FIG. 2 of the drawings:

As shown in the drawings, FIG. 2, crushed tar sand is fed, as by a vibratory or belt feeder, to one end of a mixer-extractor (illustrated as a pugmill). Solvent (methylene chloride) containing some bitumen (a portion of the stream from the sand rinser) is fed at the same end of the mixer-extractor and moves co-current with the sand moving in the mixer-extractor.

The sand and solvent moving through the mixer-extractor are directed to the low end of an inclined screw which is employed as a preferred design for the rinser. The solvent, containing 35–40% by weight bitumen exiting the rinser is partially sent to the mixer-extractor and partially directed to a fines removal system, e.g. a centrifuge multi media filter or the like. Fresh solvent is fed to the rinser at the high end of the inclined screw and flows downwardly countercurrently through the sand to rinse any remaining bitumen from the sand and dilute the miscella generated in the mixer extractor. The sand is delievered to a drier, preferably as illustrated a heated hollow screw drier (TORUS DISC), wherein with the aid of steam as a scavenger gas, the residual solvent associated with the sand is removed. The sand exits to a clean sand pile.

The solvent with preferably 35 to 40% by weight bitumen, miscella, is subjected to a fine solids a removal as aforestated. The miscella is then forwarded to a multistage solvent recovery system. The top portion of the tower removes the bulk of the solvent with rectificabitumen product (21) containing a small percentage of stripper-diluent solvent, for viscosity control, is then sent to upgrading.

As previously described, the preferred overall process involves a single-stage extraction vessel where the bitumen is rapidly and completely dissolved. A highly concentrated bitumen-solvent solution (miscella) overflows from a solids separation device and a high boiling stripper-diluent solvent is added, preferably after fines removal and bulk solvent removal, to assist in residual solvent removal in a stripper stage. The miscella is first distilled in such a fashion that preferably about 98% of the extraction solvent is rapidly vaporized off and sent back to the extraction stage via storage. The remaining extraction solvent bitumen mixture is mixed with the stripper-diluent and when the temperature of this mixture begins to exceed the boiling point of the stripper-diluent (SD) solvent, the residual solvent is carried overhead with most of the SD. This overhead is condensed and may be flashed to separate the low boiling solvent from the SD and the SD recycled with make-up SD to supply the stripper diluent to the second stage of the solvent recovery step or both SD and solvent may be returned to the solvent recovery step in the SD line (15) to the second stage. Three to four percent of the stripper-diluent is left in the bitumen to control its viscosity and give it an acceptable pumpability for subsequent processing.

The course sand from the extraction vessel is rinsed with fresh solvent prior to drying with a combination of indirect heat, direct steam impingement and aeration. The clean sand is suitable for any use since it is substantially free of solvent and tar.

The chlorinated solvents, as a class, exhibit solvency properties between those of oxycarbon and hydrocarbon solvents and generally have a good solvency for the waxes, resins and greases that are found in common industrial operations and are preferable to hydrocarbon solvents in the disclosed process. It was still surprising to find that methylene chloride exhibited such a superior solvency for all the various tar sand ores which were screened. Therefore, methylene chloride is the preferred solvent and has the added advantage of being environmentally more acceptable than the other chlorinated solvents which as a class are safer than the hydrocarbon solvents.

A spectrum of tar sand samples were evaluated to determine if factors such as tar sand source, grade, oil or water wet nature, viscosity characteristics of the contained bitumen, etc. had a significant affect on extraction rates, efficiencies and complexity of subsequent processing steps.

The results of some of these screening tests are shown in Table 1. These simple room temperature washing experiments illustrate the unusual solubility which methylene chloride has for tar sand bitumens. The same extraction efficiency was obtained for the water-wet (Athabasca) and the oil-wet (Kentucky and Utah) sands. The grade (2.84% Raven Ridge through 12.30% Athabasca) also had no effect on extraction efficiencies. The viscosity of the contained bitumen (Sunnyside approx. $10^7$ poise or PR Springs approx. $10^3$ poise) also did not appear to be a factor.

TABLE I

Multiple Washings with Methylene Chloride (Ambient Temperature)

| | Wt % carbon on sand | | | | | |
|---|---|---|---|---|---|---|
| | As received | Residual carbon/stage 1 | 2 | 3 | 4 | Wt. % sand in slurry |
| Kentucky | 5.35 | 0.60 | 0.19 | 0.21 | — | 20 |
| Utah | | | | | | |
| PR Springs | 9.42 | 2.01 | 0.06 | 0.50 | 0.33 | 50 |
| Raven Ridge | 2.84 | 0.40 | 0.16 | 0.19 | — | 15 |
| Sunnyside | 4.73 | 1.04 | 0.79 | 0.27 | 0.11 | 33 |
| Athabasca (high grade) | 12.30 | 2.05 | 0.58 | 0.21 | 0.21 | 33 |
| Diatomite McKittrick | 14.84 | 9.87 | 6.61 | 5.34 | 5.58 | 30 |

Bitumen is soluble in methylene chloride in substantially all proportions. Solutions with concentrations above 70% bitumen have been prepared in the laboratory. This unusual solvency for bitumen also manifests itself in extractions rates. FIG. 3 illustrates this point. Methylene chloride containing 20% by weight bitumen initially achieved 100% extraction in a matter of minutes for the water-wet, medium-grade, Athabasca sand as shown in FIG. 3. These rates, of course, greatly simplify the design of the extraction stage for any proposed solvent extraction process. Other tests indicate similar results, as with oil-wet, low grade Kentucky sand.

It is to be understood that single stage extraction efficiency drops off significantly at miscella concentrations in excess of about 40%. If greater than about 40% weight solutions are used the extractions will require longer extraction time or continue in the rinser stage wherein more stages may be required to achieve commercially acceptable extraction. The phenomenum is a result of viscosity increase in the greater than about 40% concentration as clearly shown in FIG. 4.

Although solvency is important, several other solvent properties also have to be considered in evaluating a solvent for a commercially-viable solvent extraction process. These considerations include safety, health effects, and potential environmental impact. Methylene chloride gives the best balance of properties relative to the above concerns; i.e., it behaves as a nonflammable solvent, it has the greatest solvency power of all the solvents evaluated (bitumen dissolves completely and very rapidly with a minimum of agitation regardless of the source or grade of tar sand being extracted), it has a workplace safety standard (TLV of 100 ppm) which can be achieved with good work practices, and it is one of five solvents which the EPA has determined to have insignificant photochemical reactivity and consequently its emissions may not have to be controlled under State VOC emission regulations. The other chlorinated sovlents, perchloroethylene and trichloroethylene are less acceptable than methylene chloride from an environmental stand point, requiring extra care in leak proof equipment. Methyl chloroform another environmentally acceptable chlorinated solvent has a problem in that it is more readily hydrolyzed in a process where water is present in the quantities here encountered.

Methylene chloride can be stripped from the bitumen fairly easy using air or steam stripping or the addition of a high boiling stripper-diluent, the latter is a preferred technique as hereinafter disclosed. Here again, the advantage of methylene chloride over the other chlorinated hydrocarbons is evidenced as the higher boiling Karnofsky (U.S. Pat. No. 4,239,617) teaches a process to recover oil from diatomaceous earth through contacting the ore with a hydrocarbon solvent in a series of countercurrent extraction stages. The solvent is removed from the spent diatomite by first contacting it with water and secondly with steam. The oil-solvent solution is evaporated in multiple-effect evaporators followed by steam stripping.

Smith, et al. (U.S. Pat. No. 3,941,679) teaches a method using trichlorofluoromethane for the in situ and surface extraction of tar sands.

Funk, et al. (U.S. Pat. No. 4,347,118) teaches a process using $C_5$ to $C_6$ hydrocarbons. A two-stage process where a concentrated bitumen-solvent solution is separated in a classifier as an overflow and the course sand underflow is sent to a countercurrent extraction column for further extraction before entering a series of fluid bed driers. The patent emphasizes the use of multistaged fluid bed drying for complete removal of the solvent.

Hanson, et al. (U.S. Pat. No. 4,139,450) teaches a countercurrent extraction method for wet sands where the water is removed with hot solvent vapors prior to the extraction process. In U.S. Pat. No. 4,071,433, they use a technique where tar sand is slurried with oil, the course sand separated by centrifuge and the fine sand, oil, bitumen stream is fed directly to a coker.

Alford, et al. (U.S. Pat. No. 4,067,796) teaches a process involving a conditioning step with an alkaline aqueous solution followed by the extraction and separation of the tar sand with a hydrocarbon solvent, in a vessel which also contains water, thus forming two immiscible liquid phases for ease of sand separation.

Gagon (U.S. Pat. No. 4,342,639) teaches the extraction of tar sand with a halogenated solvent wherein the extracted sand is separated from the bitumen solvent solution by feeding the oil-solvent-sand slurry onto a conveyor system partially submerged in water. A halogenated solvent is important, because the oil-solvent solution must be heavier than water in order to affect separation.

Gearhart (U.S. Pat. No. 4,315,815) teaches a method of separating a solvent from bitumen by pressure reduction at elevated temperatures followed by steam stripping. A device to accomplish this is also described.

None of the above patents address the need to insure the complete removal of the solvent from the extracted bitumen prior to further refining. This, of course, is not a major need when nonhalogenated solvents are used as the extracting solvent, as most of the above patents so specify. However, even those who specify a halogenated solvent, e.g., Pittman, et al., Smith, et al., and Gagon, essentially ignore the solvent-bitumen separation problem. They specify technology such as flash distillation, a conventional evaporator and ambient temperature evaporation (thought to be applicable for summer desert environments) for solvent-bitumen separation. The concern for residual chlorides in crude oil or bitumen feeds to a refinery is universal throughout the petroleum industry. Past experience with chloride-contaminated crude oil refinery feed has been extremely negative; e.g., causing major corrosion damage to various refinery units as well as causing process upsets due to catalyst poisoning. Consequently, the use of chlorinated solvents for either bitumen or crude oil extraction is generally not considerable feasible.

It is difficult to remove solvents, even the low boiling methylene chloride, to contents much below 100 ppm by conventional techniques. With hydrocarbon solvents such low levels are acceptable because they are recoverable in the bitumen refinering process. However, it is not acceptable to have halogenated hydrocarbon contents in bitumen over 100 ppm and preferably not over 10 ppm, because the chloride is corrosive to refinery equipment and can harm catalysts used in the refining process. Therefore, a procedure is needed to reduce the chlorinated hydrocarbon content in the extracted bitumen to less than 10 ppm.

BRIEF DESCRIPTION OF THE INVENTION

In accordance with the present invention a process based on unit operations conventionally employed but modified to enable the use of chlorinated solvents, particularly methylene chloride as the preferred solvent for extraction of the bitumen from the tar sands or shale. The process in general constitutes:

I. an extraction operation wherein the tar sand is contacted with the chlorinated solvent, particularily methylene chloride, to extract (dissolve) the bitumen from the sand;

II. a separation of the sand from the solvent bitumen extract;

III. (a) recovery of the bitumen free of extractant; (b) recovery of the sand free of extractant.

DETAILED DESCRIPTION OF THE INVENTION

Figure 1:
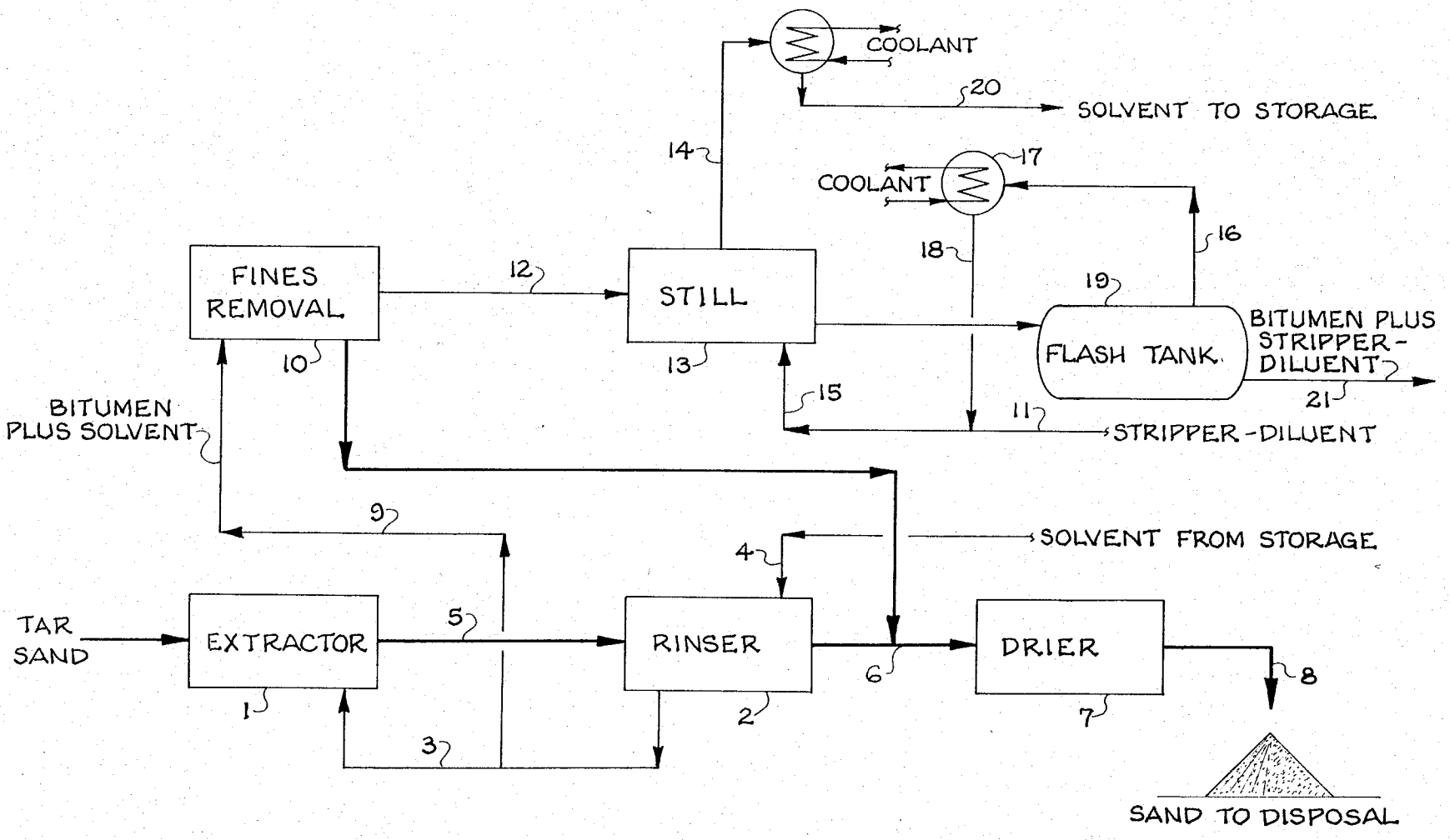
FIG. 1 represents in simplified form an overall flow diagram of the unit operations of the present invention.
Figure 2:
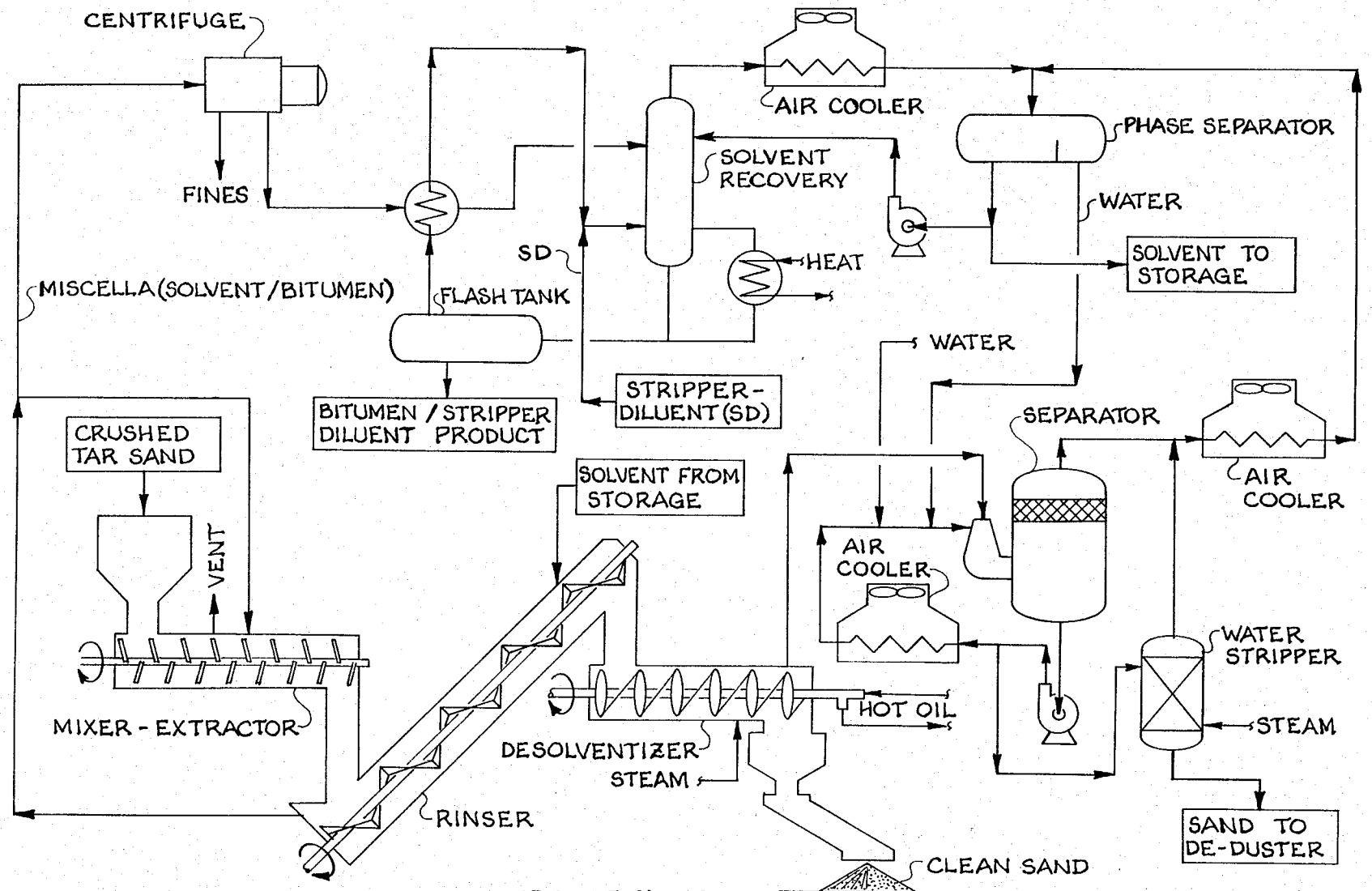
FIG. 2 represents in more detail a preferred embodiment of the present invention.
Figure 3:
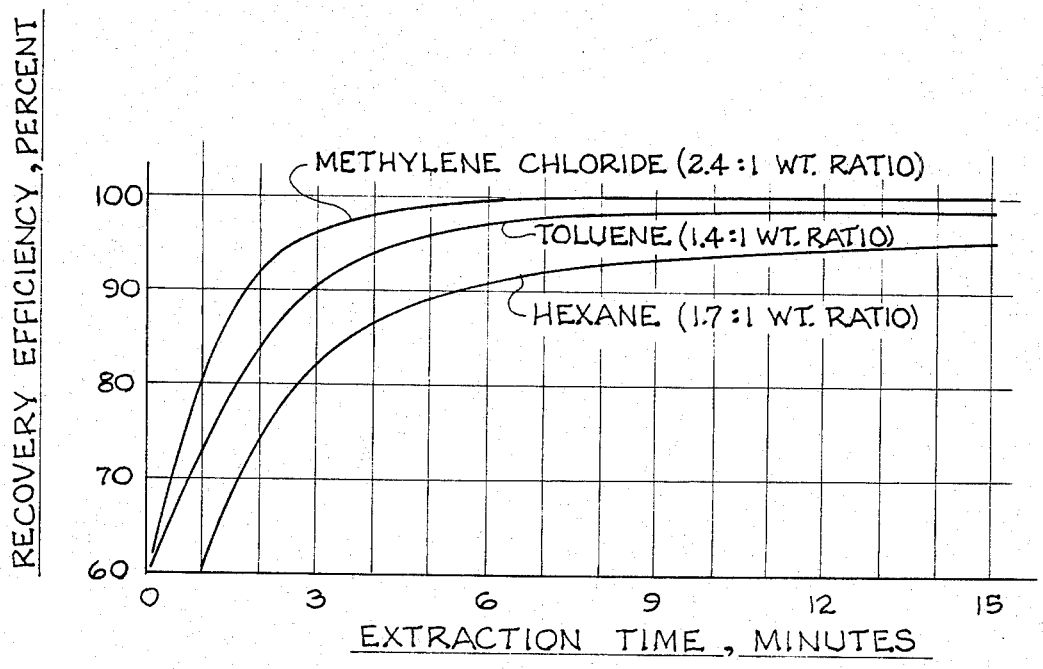
FIG. 3 represents in graphic form the relative solvency of methylene chloride, hexane and toluene for bitumens from Athabasca and Kentucky tar sands, respectively.
Figure 4:
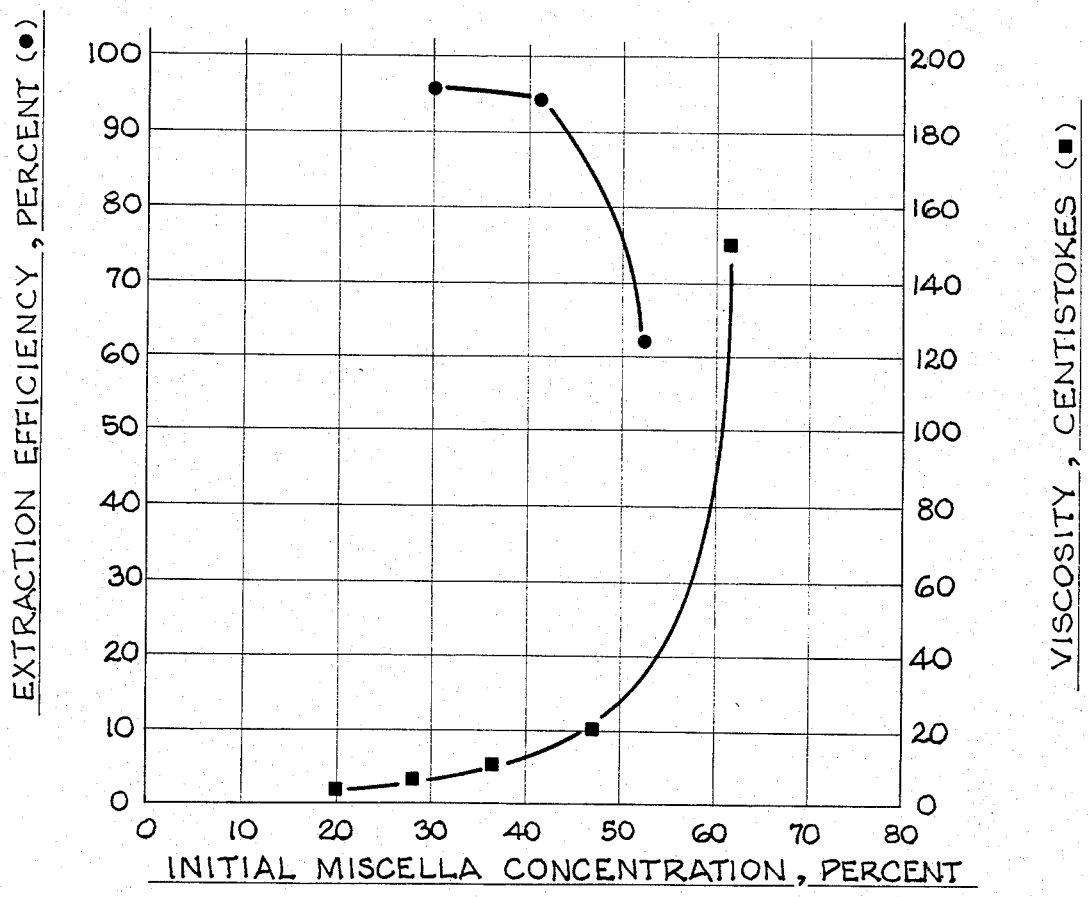
FIG. 4 represents in graphic form the viscosity of mixtures of bitumen and methylene chloride.

In greater detail, reference is had to FIG. 1 which illustrates a simple flow diagram of the essential elements of the process. Tar sand is fed into a mixer-extractor (1) into which solvent is also fed by line (3) from the rinser stage (2). Fresh solvent is fed to the rinser (2) from storage indicated by line (4). The extracted sand leaves the mixer-extractor (1) through line (5) and enters the rinser (2). The rinsed sand leaves the rinser (2) through line (6) and enters the drier (7). The clean, dry sand leaves the drier by line (8) for disposal. A portion of the solvent-bitumen solution (miscella) leaving the rinser (2) through line (3) is withdrawn through line (9) where it enters a fines removal step (e.g. a centrifuge) (10). Upon exiting the fines removal (10) the miscella, via line (12), enters a solvent recovery system having a distillation stage (13) where most of the extraction solvent is removed through line (14), condensed and forwarded to storage via line (20). In a second stage of the recovery system (13), the bitumen substantially free of solvent, falling from the first stage is mixed with a stripper diluent which comes from storage via line (11) and from recycle line (18). In a flash tank (19) the bitumen-stripper-residual solvent mixture is subjected to a high temperature flash distillation to remove residual extraction solvent and most of the stripper-diluent as overhead, which overhead is lead via line (16) to condensor (17), wherein the two components are condensed and introduced via line (18) to line (15) into still (13). The

PROCESS FOR RECOVERY OF SOLVENT FROM TAR SAND BITUMEN

BACKGROUND OF THE INVENTION

In the United States there are about 550 tar sand occurrences known to exist in 22 states. These deposits are estimated to contain up to 50 billion barrels of crude. By far the most important deposits are the near-surface tar sands of Utah, which are estimated to contain 22–29 billion barrels of petroleum with 96% of the oil occurring in sandstone rock in six major deposits. Of the 50 billion barrels of the identified U.S. tar sand reserves, about 10% (5 billion barrels) are located close enough to the surface to be mined by conventional open pit techniques and extracted at the mine site.

A variety of techniques have been proposed for the surface extraction of bitumen from tar sands; e.g., hot or cold water with flotation, water-solvent mixtures, and solvent extraction. Of these techniques, water separation has an advantage in that the equipment requirements are relatively simple and it is an established, commercial method for the processing of Canadian tar sands. However, the water wet nature and bitumen composition of the Athabasca tar sands is unique; and, consequently, it has not been possible to directly apply the Canadian technology to U.S. tar sands.

Water separation processes are essentially mechanical methods. They suffer from the disadvantage in both the low efficiency of displacement of the bitumen from the sand and the poor flotation behavior of the released bitumen which latter is strongly influenced by changes in bitumen viscosity within a particular ore body. Water processes also require significant volumes of water which must be recycled to approach economical operation. Consequently, methods for minimizing the formation of oil/water emulsions and means of treating fine-clay/water suspensions are generally required. Efficient water recycle is not only important in order to avoid costly environmental problems, but it is also scarce and generally closely regulated in those areas of the U.S. where most tar sand deposits are located.

Water-solvent processes are chemical dissolution methods which offer the potential advantage of diminishing the energy associated with a sand drying operation, but suffer many of the disadvantages of the water extraction process with regards to clarifying and recylcing large volumes of water. Difficult to break water-/oil/solvent emulsions also present a significant problem.

Solvent extraction appears to be especially suited for the surface extraction of the oil-wet tar sands found in the U.S. However, essentially all the developmental work which has previously taken place for the solvent extraction of tar sands has been carried out using hexane and similar light petroleum hydrocarbon solvents. These types of chemical extractants are not good solvents for bitumen. The asphaltenic content of bitumen (normally in the range of 15–25%) is not readily soluble in aliphatic hydrocarbon solvents. Consequently, slow dissolution rates, poor extraction efficiencies, column plugging due to reprecipitated asphaltenes, and the expense and difficulty required in recycling large volumes of such extremely hazardous solvents has discouraged many workers from pursuing a solvent extraction process approach for the recovery of bitumen from tar sands. The properties of several commercially-important chlorinated solvents could obviously overcome many of the objections inherent in the use of hydrocarbon solvents; however, they are generally perceived as not suitable for this application because of both their thermal and hydrolytic instability at elevated temperatures and consequent corrosion potential.

There are myriads patents which disclose processes for recovering bitumen from tar sands and oil-shale as well as unique and conventional solvent systems for use in particular processes having modified steps both in treatment and solvent recovery. Exemplary of these patents are Hastings, U.S. Pat. No. 4,311,561; L. I. Hart et al., U.S. Pat. Nos. 4,054,506 and 4,054,505; R. G. Murray et al., U.S. Pat. Nos. 4,120,775 and 4,176,465; T. A. Pittman, et al., U.S. Pat. Nos. 3,856,474 and 4,029,568; G. B. Karnofsky, U.S. Pat. No. 4,239,617; C. D. Smith et al., U.S. Pat. No. 3,941,679; E. W. Funk et al., U.S. Pat. No. 4,347,118; D. 0. Hanson, U.S. Pat. Nos. 4,139,450 and 4,071,433; H. E. Alford, et al., U.S. Pat. No. 4,067,796; H. W. Gagon, U.S. Pat. No. 4,342,639; and J. A. Gearhart, U.S. Pat. No. 4,315,815, as well as the references cited during prosecution and those referenced referred to in developing the background of the invention in each patent.

In general these patents describe techniques where sand is contacted in a series of extraction tanks and columns, with or without agitation, or where the sand is placed in a perforated container or a conveyor belt and the solvent is sprayed on the top and allowed to percolate through the bed of sand. In most cases, these techniques are designed to increase the extraction efficiency of the solvents being used. The other aspect most often mentioned are techniques to remove the solvent from the sand after the extraction stage; e.g., water displacement of the solvent from the extracted sand, multifluid bed driers, etc. Sands are conveyed between the various stages of these processes by accepted commercial practices; i.e., screw, slurry pumps, conveyor belts, etc.

Hastings (U.S. Pat. No. 4,311,561) teaches a countercurrent multistage vessel process. The last vessel in the series is filled with hot water as a means of removing entrained solvent from the sand prior to disposal.

Hart, et al. (U.S. Pat. Nos. 4,054,506 and 4,054,405) teaches a method of using ultrasonics to enhance the recovery of bitumen from tar sands.

Murray, et al. (U.S. Pat. No. 4,120,775) teaches a tar sand extractor design in which the leached tar sand is classified into fine and course fractions. The fine sand stays with the miscella, while the course fraction falls to the bottom where it is collected for removal from the extractor (fine sand retention permits easier washing and draining). In a second patent (U.S. Pat. No. 4,176,465), they teach a method for drying sand in a device designed to utilize the latent heat of vaporization of solvent vapors of the condensing solvent to preheat the sand entering the drier.

Pittman, et al. (U.S. Pat. No. 3,856,474) teaches an apparatus for extracting bitumen from tar sands by spraying solvent on tar sand conveyed on a perforated moving belt. Primary emphasis is on the design of the conveyor belt. In U.S. Pat. No. 4,029,568, they teach the use of high-pressure sprays, from 1–100 psi, with their conveyor belt extraction system. Their preferred solvents are methyl chloroform, trichloroethylene and perchloroethylene, because of "their high solvent effect, low boiling point, low specific heat and low heat of vaporization".

tion. In the lower section the bitumen which has substantially all of its solvent removed in the upper stages is preferably mixed with from about one (1) to about 100 percent of a hydrocarbon material (SD) having a boiling point higher than the solvent which will act as a stripping agent for removing residual solvent. The stripping agent is added after the bulk solvent removal to assist in the final methylene chloride removal and to enable the solvent free bitumen to be pumpable. Thus, the stripping agent acts as a viscosity control for the bitumen after bulk solvent removal. As aforestated, the stripper-diluent (SD) should preferably be a constitutent of the upgraded bitumen thus introducing no impurity or material which must be removed during the upgrading stage.

Following the bulk removal of the solvent, in for example, a sieve tray distillation column, and addition of SD the bitumen/residual solvent in the second stage, a trace of SD and substantially all of the residual solvent are boiled off. The bitumen then has only traces of solvent remaining, preferably less than 10 ppm, but retains sufficient SD to be pumped to the upgrading step: SD content can conveniently be controlled by flashing off any excess added to aid in solvent stripping.

The bitumen-free sand leaving the inclined screw rinser is fed to a drier. Some drainage takes place in the screw, however, solvent hold up on the sand will generally be on the order of 20–30 weight percent. For desolventizing purposes, we have chosen the heated hollow screw drier, called the TORUSDISC, marketed by Bepex Corp. This choice was based on cost and efficiency. Although, from our experience the desolventizers currently used by the oilseed extraction industry appear to be equally effective.

Drying experiments carried out in the TORUS DISC using solvent-extracted Kentucky tar sands in order to obtain the information required for sizing and scale-up, utilized a hot oil system and sand feed initially containing approximately 25 percent by weight methylene chloride was desolventized fairly rapidly approaching a final residual solvent level of 100 ppm. The addition of a 12 lb/hr steam sparge accelerated solvent removal, and residual solvent levels approaching 1 ppm were fairly easily achieved. In order to avoid any chance for groundwater contamination due to the leaching of solvent from the backfilled sand a 1 ppm or less solvent level is a reasonable and achievable objective.

The solvent vapors exiting the desolventizer carry with them a considerable portion of fine sand particles which require separation therefrom to enable the solvent to be recycled. These vapors with the attendant fines are quenched in a water jet which exits into a large container, a solids separator, wherein the sand wet with water falls to the bottom as does the major part of the water, is withdrawn and the bottoms stream split, part to recycle to the jet and part to a water stripper wherein steam strips the residual solvent from the water. This water containing fine sand particles can be combined with coarser sand from the desolventizer and used as land fill. The solvent vapors, and unquenched steam from the desolventizer, pass through a demister and are joined with the vapors from the stripper, condensed and sent to a water separator. The solvent from the separator is recycled to the process and the water used as a principal source of water to the jet in the solids separator.

In practice a vent collecting system is associated with the process units. The preferred vent collecting system is an absorber/stripper operation wherein the vents which contain various constituents of the process as well as large volumes of air and other inert gases carried into the process with the tar sand and/or generated or released during the various steps of the process are absorbed in an oleogeneous liquid, for example, a mineral oil, which absorbs the hydrocarbons and chlorinated solvents, allowing the non-condensible and inert gases ($N_2$, $O_2$, $H_2$, etc.) to pass to the atmosphere. The rich oil is sent to a stripper where heat is applied, preferably steam, to strip the volatiles from the oil. The vapors go to a phase separator and the condensate, principally the methylene chloride, added back to the process.

While each unit operation has been described illustrating a preferred embodiment of equipment it is to be understood that various pieces of mechanical apparatus may be used in accordance with the present invention to accomplish the unit operations necessary to effectuate the results herein described. For example vibrating pan screw or belt feeders, the latter with or without vibratory assists may be used to feed the tar sand to the extractor-mixer. The extractor mixer may be a pug null, tumbler (sag mill), with or without vibratory assists where appropriate. A mixer-settler may be used for both the mixer, initial extraction and rinsing steps. Rinsers such as inclined screws, percolation beds and vacuum belts may be used with good results. Centrifuges, filters and settlers may be used for fines removals. Various means for vapor recovery include, oil absorbers, carbon absorption and incineration.

Suitable stripping diluents (SD) include the intermediate boiling hydrocarbon fractions such as mineral spirits, Stoddard Solvent, xylene, kerosene and #2 diesel oil, preferably one or more of those hydrocarbon fraction employed or produced in the upgrading process. Other hydrocarbon blends of suitable boiling range can be employed. Pure components such as ethyl benzene can be likewise utilized.

These intermediate hydrocarbons will assist the removal of the commercially available chlorinated hydrocarbons, methylene chloride, 1,1,1-trichloroethane, trichloroethylene and perchloroethylene.

The amount of the hydrocarbon added can vary from about 1% by weight to about 99% by weight based on the methylene chloride employed. Preferably, however, 2 to 15% by weight and most preferably 5–7% by weight are employed. However, when the bitumen is to be sent to an upgrading unit nearby it may be advantageous to employ 40–100% added SD depending on the process.

No particular pressure is more advantageous than another, merely raising or lowering the boiling temperatures and bearing on the economics.

It is also to be understood that while the described solvent recovery process has particular utility to removal of chlorinated hydrocarbons from the bitumen, the procedure may also be used to recover chlorinated hydrocarbons from crude oils or other oleogeneous liquids.

In carrying out the process of the present invention air or inert gas stripping may also be used to strip chlorinated solvent residuals, although significant solvent loses or increased cost of operation is incurred. Recovery of the solvent from such inert gas stream requires cryogenic temperatures or alternate absorption equipment, such as carbon or mineral oil absorbers. Steam as a stripping agent is likewise effective. However, the resultant contamination of the solvent and bitumen with water is undesirable.

EXAMPLE 1

A laboratory distillation was carried out to establish the effect of a stripper-diluent in recovery of the methylene chloride, using ethyl benzene (136 degrees C. boiler) as the added intermediate boiling hydrocarbon. A laboratory scale still, was charged with a mixture of 72.33% wt. methylene chloride, 12.65% wt. Asphalt Ridge bitumen and 15.02% wt. ethyl benzene. After boiling was established and the bulk of the solvent removed, the pot temperature began to exceed 40° C. At this point, pot temperatures were recorded as a function of residual methylene chloride in the bitumen. The data table (Table II) below lists boiling range and residual methylene chloride. Note the distinct drop in methylene chloride concentration as the boiling point of ethyl benzene is reached.

TABLE II

METHYLENE CHLORIDE RECOVERY FROM ASPHALT RIDGE BITUMEN

| Bottoms Boiling Range (°C.) | Residual Methylene Chloride in Bitumen wt. % |
|---|---|
| 40–109 | 6.8952 |
| 109–124 | 2.7286 |
| 124–139 | 0.5507 |
| 139–146 | 0.00005 |
| 146–168 | 0.00001 |
| 168–186 | 0.00001 |
| 186–206 | N.D.* |

*Not Detectable

For comparison to alternate technologies, additional distillations were performed with the same apparatus, bitumen and extraction solvent as well as with nitrogen as a stripping aid.

EXAMPLE 2

A similar distillation was carried out except nitrogen stripping was used. A mixture containing 85.2% methylene chloride and 14.8% Asphalt Ridge Bitumen was charged to the distillation device. Once the boiling point of methylene chloride was exceeded, nitrogen was sparged into the bitumen mass at a rate of 0.13 cu. ft. per lb. of bitumen per minute.

TABLE IV

METHYLENE CHLORIDE RECOVERY FROM ASPHALT RIDGE BITUMEN

| Bottoms Boiling Range (°C.) | Residual Methylene Chloride in Bitumen wt. % |
|---|---|
| 40–128 | 3.8505 |
| 128–151 | 1.22 |
| 151–175 | 0.6153 |
| 175–192 | 0.0365 |
| 192–201 | 0.0032 |

EXAMPLE 3

An additional distillation of methylene chloride from Kentucky bitumen was made using an intermediate boiling hydrocarbon blend as the S-D. The intermediate boiling hydrocarbon blend chosen is a commercial aromatic hydrocarbon solvent SC-100 distributed by CHEM CENTRAL, Chicago. The boiling range of the solvent is 155°–173° C. and the chemical makeup is 98% aromatics. To 63 grams of bitumen was added 25 grams of SC-100 and 250 grams of methylene chloride. The resulting mixture containined 7.4% chaser solvent, 18.6% bitumen and 74% methylene chloride by weight. As the vapor temperature exceeds the initial boiling temperature of the SC-100 (155° C.) methylene chloride level in the bottoms was non-detectable.

TABLE V

Methylene Chloride Recovery from Kentucky Bitumen

| Temperature, °C. | | Wt % Methylene Chloride |
|---|---|---|
| Bottoms | Vapor | in Bitumen |
| 90 | 50 | 23.1 |
| 180 | 110 | 0.099 |
| 230 | 168 | N.D.* |
| 300 | 170 | N.D. |

*Not Detected

COMPARATIVE EXAMPLE

For comparison purposes a direct distillation of a mixture containing 86.4% methylene chloride and 13.6% Asphalt Ridge Bitumen was run. Boiling range vs. wt % solvent in the bottoms is listed below. Note that although the bottoms temperature exceeds 4 times the boiling point of methylene chloride, considerable amounts of solvent remains.

TABLE III

METHYLENE CHLORIDE RECOVERY FROM ASPHALT RIDGE BITUMEN

| Bottoms Boiling Range (°C.) | Residual Methylene Chloride in Bitumen wt. % |
|---|---|
| 40–89.5 | 20.2117 |
| 89.5–122 | 6.4450 |
| 122–144 | 4.8513 |
| 144–163 | 2.1583 |
| 163–184 | 1.6544 |
| 184–200 | 0.5413 |

We claim:

1. A process for recovering bitumen from tar sands which comprises:
   (1) extracting bitumen from tar sand by mixing in co-current flow the tar sand with chlorinated hydrocarbons which may contain bitumen,
   (2) withdrawing from said extracting step a chlorinated hydrocarbons bitumen extract containing from about 20 to 50 weight percent bitumen,
   (3) rinsing in a counter current manner the extracted tar sand with chlorinated hydrocarbons to remove residual bitumen and forwarding a portion of said rinse composition to step 1,
   (4) drying the sand from step 3 in a heated steam purged drying zone,
   (5) recovering the solvent vaporized in step 4 and returning it to the process,
   (6) recovering the extracting solvent from the solvent bitumen extractor by treating the extract of step 2 to remove sand fines, distilling the major portion of the solvent, and then mixing the resulting bitumen containing a small portion of the solvent with a higher boiling hydrocarbon while removing the chlorinated hydrocarbon thereby to obtain a bitumen substantially free of chlorinated hydrocarbon but containing sufficient hydrocarbon to be pumpable.

2. A process for recovering bitumen from tar sands which comprises (1) contacting the tar sand with a chlorinated hydrocarbon solvent, which may contain bitumen dissolved therein, in cocurrent flow with said sand to extract the bitumen;

(2) withdrawing from said contacting step an extract of chlorinated hydrocarbon containing from 20 to about 50 weight percent bitumen dissolved therein;

(3) treating said extract to remove fines of sand entrained therein, (4) separating said solvent from said bitumen by distillation, a part of which separation is carried out in the presence of an added hydrocarbon liquid boiling higher than said solvent and continuing said distillation until substantially less than 10 parts of solvent per million parts of bitumen-hydrocarbon liquid remain, thereby obtaining a pumpable bitumen hydrocarbon liquid suitable for upgrading, (5) subjecting said sand from step 1 to a counter current solvent rinse zone;

(6) forwarding a portion of said rinse solvent to step 1 as the prinicpal extractant, (7) drying the rinsed sand in a heated and steam purged zone to recover the solvent for reuse in the process.

3. A process for recovering bitumen from tar sands which comprises:

(1) extracting bitumen from tar sand by mixing in co-current flow the tar sand with methylene chloride which may contain bitumen, (2) withdrawing from said extracting step a methylene chloride bitumen extract containing from about 20 to 50 weight percent bitumen, (3) rinsing in a counter current manner the extracted tar sand with methylene chloride to remove residual bitumen and forwarding a portion of said rinse composition to step 1, (4) drying the sand from step 3 in a heated steam purged drying zone, (5) recovering the solvent vaporized in step 4 and returning it to the process, (6) recovering the extracting solvent from the solvent bitumen extractor by treating the extract of step 2 to remove sand fines, distilling the major portion of the solvent, and then mixing the resulting bitumen containing a small portion of the solvent with a higher boiling hydrocarbon while removing the chlorinated hydrocarbon thereby to obtain a bitumen substantially free of methylene chloride but containing sufficient hydrocarbon to be pumpable.

4. A process for recovering bitumen from tar sands which comprises (1) contacting the tar sand with methylene chloride, which may contain bitumen dissolved therein, in cocurrent flow with said sand to extract the bitumen;

(2) withdrawing from said contacting step an extract of methylene chloride containing from 20 to about 50 weight percent bitumen dissolved therein;

(3) treating said extract to remove fines of sand entrained therein, (4) separating said methylene chloride from said bitumen by distillation, a part of which separation is carried out in the presence of an added hydrocarbon liquid boiling higher than said methylene chloride and continuing said distillation until substantially less than 10 parts of methylene chloride per million parts of bitumen-hydrocarbon liquid remain, thereby obtaining a pumpable bitumen hydrocarbon liquid suitable for upgrading, (5) subjecting said sand from step 1 to a counter current methylene chloride rinse zone;

(6) forwarding a portion of said rinse methylene chloride to step 1 as the principal extractant, (7) drying the rinsed sand in a heated and steam purged zone to recover the methylene chloride for reuse in the process.

5. A process for recovering bitumen for upgrading from tar sands which comprises:

(1) contacting the tar sand with methylene chloride, which is the rinse solvent from sand rinsing step 2, in a cocurrent flow extractor, (2) conveying the extracted sand through an uprising rinse step which flows the extractant solvent in a countercurrent downflow manner to said uprising sand and delivering a portion of the rinse solvent extractant to the extractor, (3) drying the sand to remove the residual extractant solvent by indirect heat accompanied by counter current steam sparging, and recovering the solvent vapors for resue, (4) withdrawing from said extractor a fluid stream consisting of the extractant solvent, bitumen and sand fines, (5) removing the sand fines in a centrifugal filter, (6) removing the extractant solvent by a multi-stage distillation wherein the lower stages a stripper diluent compatible with a bitumen upgrading process is added to assist in final removal of the extractant solvent, (7) recovering the extractant solvent for reuse, (8) connecting all vents from the recited unit operations to an oleogeneous liquid absorber to collect the methylene chloride from such vent gases and venting the non-absorbed gases, (9) heating the methylene chloride rich oleogeneous liquid absorbent to release the methylene chloride and its stabilizers, if any, returning the methylene chloride to the bitumen extracting or rinse step, and the lean oil to the absorber.

* * * * *